US006790281B2

(12) United States Patent
Doi et al.

(10) Patent No.: US 6,790,281 B2
(45) Date of Patent: Sep. 14, 2004

(54) FINELY-DIVIDED POWDER SPRAY APPARATUS

(75) Inventors: Shin Doi, Saitama-ken (JP); Masaki Ban, Saitama-ken (JP); Goro Watanabe, Saitama-ken (JP)

(73) Assignee: Nisshin Engineering Co., Ltd., Tokyo (JP)

( * ) Notice: Subject to any disclaimer, the term of this patent is extended or adjusted under 35 U.S.C. 154(b) by 154 days.

(21) Appl. No.: 09/884,978

(22) Filed: Jun. 21, 2001

(65) Prior Publication Data

US 2002/0036240 A1 Mar. 28, 2002

(30) Foreign Application Priority Data

Aug. 21, 2000 (JP) ..... 2000-249416

(51) Int. Cl.[7] ..... B05C 19/00

(52) U.S. Cl. ..... 118/308; 118/309; 118/323; 118/665; 118/690; 427/184; 427/421

(58) Field of Search ..... 118/665, 308, 118/309, 358–690, 323; 427/184, 421

(56) References Cited

U.S. PATENT DOCUMENTS 6,190,455 B1 2/2001 Doi et al.

6,270,579 B1 * 8/2001 Subramanian et al. ..... 118/663

2002/0017236 A1 2/2002 Doi et al.

FOREIGN PATENT DOCUMENTS

| | | |
|---|---|---|
| CN | 1230469 | 10/1999 |
| CN | 1337277 | 2/2002 |

* cited by examiner

*Primary Examiner*—Richard Crispino
*Assistant Examiner*—Michelle Acevedo Lazor
(74) *Attorney, Agent, or Firm*—Oblon, Spivak, McClelland, Maier & Neustadt, P.C.

(57) ABSTRACT

The present invention provides a finely-divided powder spray apparatus having a spray nozzle pipe for discharging finely-divided powders from the tip together with a gas stream, which is disposed at a prescribed distance from the member to be sprayed and inclined in a prescribed direction to the member; and a moving-speed control means which controls the moving-speed of the tip of the spray nozzle pipe in accordance with the quadratic function, which indicates the reduction rate of the density of the deposited finely-divided powders based on the distance between a peak point of the density of the finely-divided powders deposited on the member to be sprayed in a trial spray and a spray point at which an extension from the spray nozzle pipe intersects with the member to be sprayed.

8 Claims, 10 Drawing Sheets

FINELY-DIVIDED POWDER SPRAY APPARATUS

FIELD OF THE INVENTION

The present invention relates to a finely-divided powder spray apparatus for discharging finely-divided powders together with a gas flow onto a member to be sprayed such as a substrate by inclining a spray nozzle pipe.

BACKGROUND OF THE INVENTION

A spacer spray apparatus is known as a representative example of finely-divided powder spray apparatuses, the apparatus uniformly spraying a prescribed amount of spacers for liquid crystal displays (spacer beads) as the finely-divided powders having a uniform particle size between substrates constituting a liquid crystal display panel for liquid crystal display devices, for example, between a glass substrate and a glass or plastic substrate so that the spacers are formed into a single layer.

In the liquid crystal display panel of a liquid crystal display device and the like, particles (spacer beads such as plastic particles and silica particles) having a uniform particle size of about several microns to several tens of microns are sprayed or coated as spacers as uniformly as possible in an amount of 10 to 2000 particles per unit area of 1 $mm^2$ to form a single layer between substrates, for example, between glass substrates, between plastic (organic glass, etc.) substrates other than the glass substrates, and between the plastic substrate and the glass substrate, (hereinafter the glass substrate will be described as a representative example and the aforementioned member to be sprayed are simply referred to as the glass substrate as a whole) so that the space to charge liquid crystals is formed.

Some conventional spacer spray apparatuses spray spacer particles onto the glass substrate by transporting the fine spacer particles together with a gas flow of air, nitrogen, etc., through a thin pipe (transportation pipe) and discharging the particles from a swinging spray nozzle pipe together with the gas stream. The spacer particles are finely-divided powders having a size of several microns to several tens of microns, and liable to float. They are various types of plastic particles or silica particles, and liable to be charged. Therefore, it is difficult to spray the spacers onto the glass substrate at a prescribed density with excellent repeatability. These apparatuses can charge the spacer particles in accordance with a charged polarity (electrostatic polarity) and ground the glass substrate and a table so as to reliably spray the spacer particles onto the glass substrate at the prescribed density.

SUMMARY OF THE INVENTION

Recently, the size of a liquid crystal display panel has been increased gradually and a plurality of liquid crystal display panels have often been made of a single glass substrate, and it is therefore required to spray the spacers in a wider area. Thus, an increased swing angle has been required for the spray nozzle pipe to spray the spacers. Accordingly, a distance from the tip of the spray nozzle pipe to the substrate at the center of the substrate is increasingly different from that at the ends of the substrate, and it is difficult to uniformly spray the spacers onto the larger glass substrate.

An object of the present invention is to provide a finely-divided powder spray apparatus, which can uniformly spray finely-divided powders such as spacers onto a member to be sprayed such as a large glass substrate.

The finely-divided powder spray apparatus of the present invention having a spray nozzle pipe for discharging finely-divided powders from the tip onto a member to be sprayed together with a gas stream, which is disposed at a prescribed distance from the member to be sprayed and inclined in a prescribed direction; and a moving-speed control means which controls a moving-speed of the tip of the spray nozzle pipe based on a density distribution of the finely-divided powders deposited on the member to be sprayed in a trial spray.

In the finely-divided powder spray apparatus of the present invention, the density distribution is represented by a quadratic function which indicates a reduction rate of a density of the deposited finely-divided powders, based on a distance between a peak point in the trial spray and a spray point at which an extension from the spray nozzle pipe intersects with the member to be sprayed.

Further, in the finely-divided powder spray apparatus of the present invention, the quadratic function is composed of a X-axis quadratic function, which indicates a reduction rate of the density of the deposited finely-divided powders based on the distance between the peak point on the X-axis and the spray point, and a Y-axis quadratic function, which indicates a reduction rate of the density of the deposited finely-divided powders based on the distance between the peak point on the Y-axis and the spray point.

Further, in the finely-divided powder spray apparatus of the present invention, a moving-speed of the tip of the spray nozzle pipe is decreased under control as the reduction rate of the density of the deposited finely-divided powders is increased.

According to the finely-divided powder spray apparatus of the present invention, the moving-speed of the tip of the spray nozzle pipe is lowered under control by a moving-speed control means in accordance with the quadratic function, which indicates the reduction rate of the density of the deposited finely-divided powders based on the distance between the peak point in the trial spray and the spray point, as the reduction rate of the density of the sprayed finely-divided powder is increased, whereby the finely-divided powders may be uniformly sprayed on the larger member to be sprayed.

DETAILED DESCRIPTION OF THE PREFERRED EMBODIMENTS

A finely-divided powder spray apparatus of the present invention will be described below in detail based on the preferable embodiments shown in the accompanying drawings.

Figure 1:
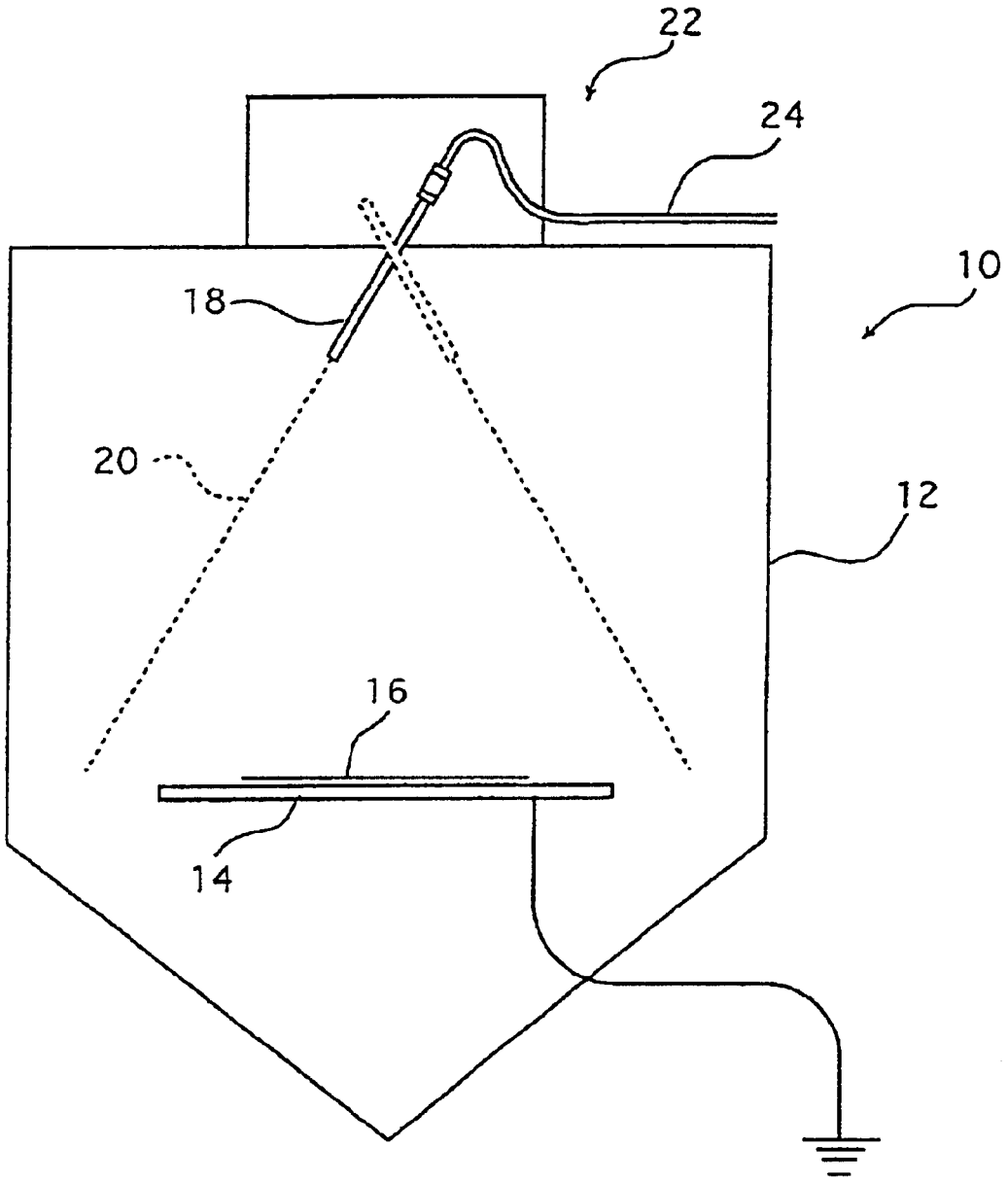
FIG. 1 is a cross-sectional view of a finely-divided powder spray apparatus of the present invention.

FIG. 1 is a sectional view of the finely-divided powder spray apparatus of the present invention.

In the figure, a spacer spray apparatus 10 as the finely-divided powder spray apparatus of the present invention has a glass substrate 16 as a member to be sprayed, which is fixed to a table 14 disposed in a lower portion of a hermetically-sealed chamber 12. The table 14 is grounded and thereby grounds the glass substrate 16 mounted on it so that spacers 20 as charged finely-divided powders are surely deposited on the surface of the grounded glass substrate.

A spray mechanism 22, having a spray nozzle pipe 18 for spraying the spacers 20, is disposed above the table 14. The spray nozzle pipe 18 discharges the spacers 20 transported through a flexible tube 24 together with a gas stream of air, a nitrogen gas, etc. and sprays the spacers 20 onto the glass substrate 16. The spray nozzle pipe 18 can be swung in an of prescribed first direction and second direction perpendicular to the first direction, for example, in any of an X-axis direction and a Y-axis direction. The spray nozzle pipe 18 discharges the spacers 20 together with the gas stream while inclining in a prescribed direction, whereby the spacers 20 can be sprayed out at a prescribed position of the glass substrate 16.

Figure 2:
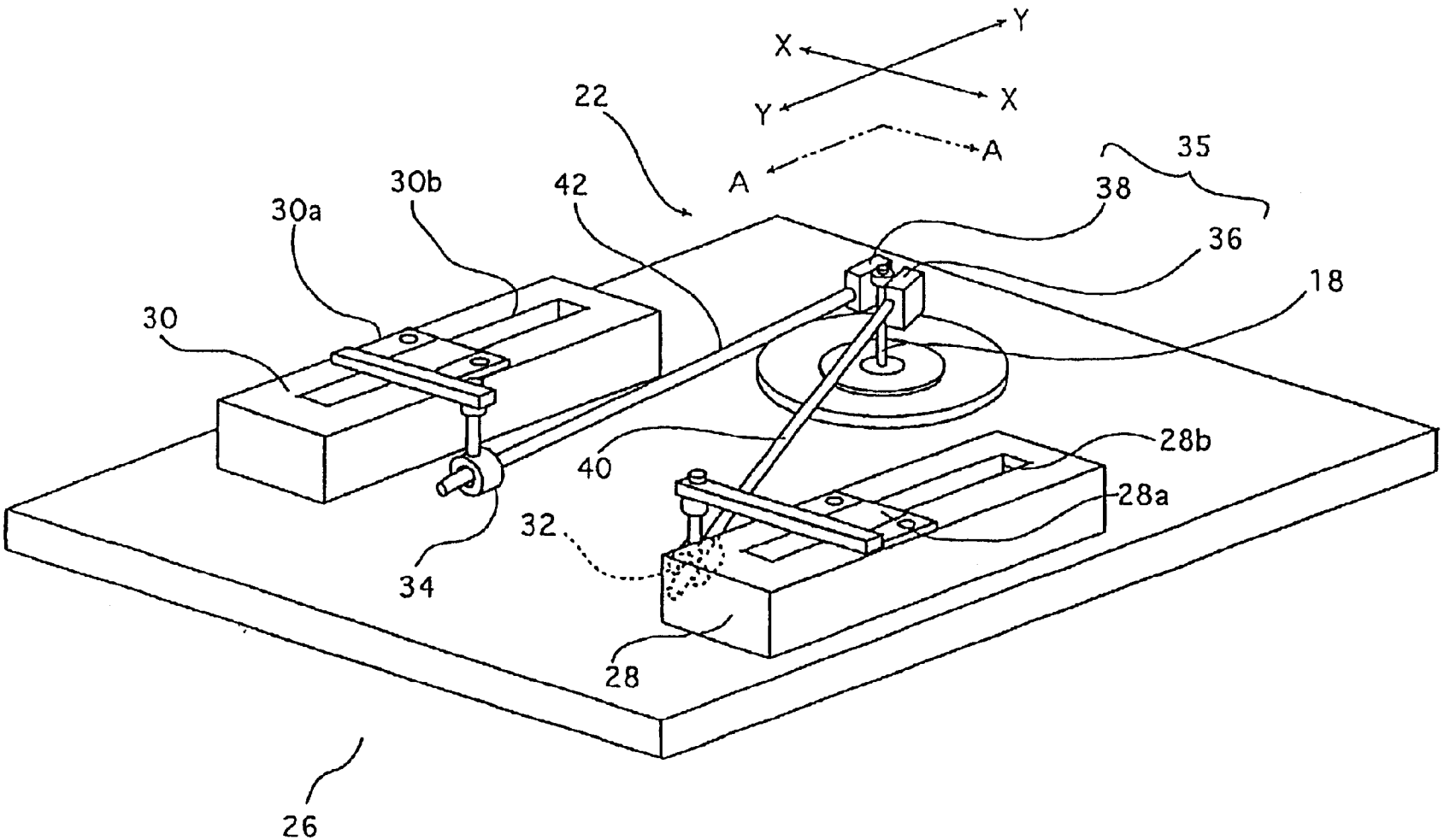
FIG. 2 is a schematic perspective view of a finely-divided powder spray mechanism used for the finely-divided powder spray apparatus of the present invention.

FIG. 2 is a perspective view schematically showing the spray mechanism 22 for the spacers 20 in the spacer spray apparatus 10 of the present invention.

In the figure, the spray mechanism 22 is arranged so that two linearly-moving actuators 28 and 30 are disposed on a mounting table 26 in parallel with each other in the Y-axis direction. Second joint units 32 and 34 composed of adjustable joints (spherical joints) are disposed on the inner sides of the linearly-moving actuators 28 and 30, respectively. The spray nozzle pipe 18 is disposed in back of the two linearly-moving actuators 28 and 30 along the centerline therebetween so that the spray nozzle pipe 18 can be swung in any of the X-axis direction and the Y-axis direction and inclined in an arbitrary direction. The linearly-moving actuators 28 and 30 have sliders 28*a* and 30*a*, and guides 28*b* and 30*b* disposed in parallel with the Y-axis direction, respectively, wherein the sliders 28*a* and 30*a* reciprocate in the Y-axis direction along the guides 28*b* and 30*b*, respectively. The linearly-moving actuators used in the present invention are not particularly limited and an AC-servo-driven linear actuator, a linear stepping motor and the like can be used.

A first joint unit 35 is attached to the upper end of the spray nozzle pipe 18. In the figure, adjustable joints (universal joints) 36 and 38, which project toward both the sides in the X-axis direction, are employed as the first joint 35. The second joint units (adjustable joints) 32 and 34, which are disposed on the inner sides of the linearly-moving actuators 28 and 30, are coupled with the adjustable joints 36 and 38 of the first joint unit 35 attached to the upper end of the spray nozzle pipe 18 through two rods 40 and 42, respectively.

Figure 3:
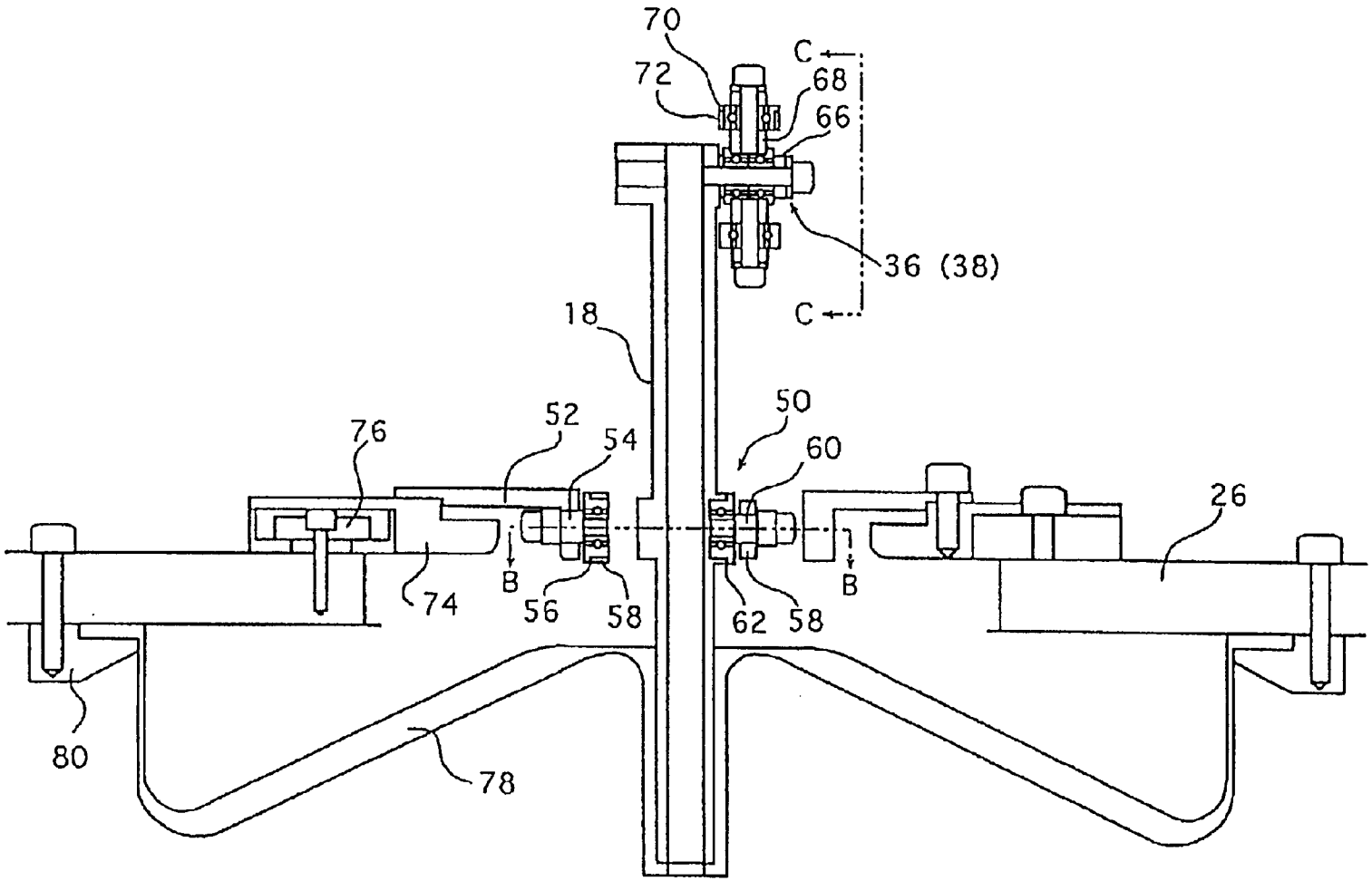
FIG. 3 is a cross-sectional view along the line A—A of FIG. 2 showing in detail a swing mechanism for swinging a spray nozzle pipe in the finely-divided powder spray mechanism of the present invention.
Figure 4:
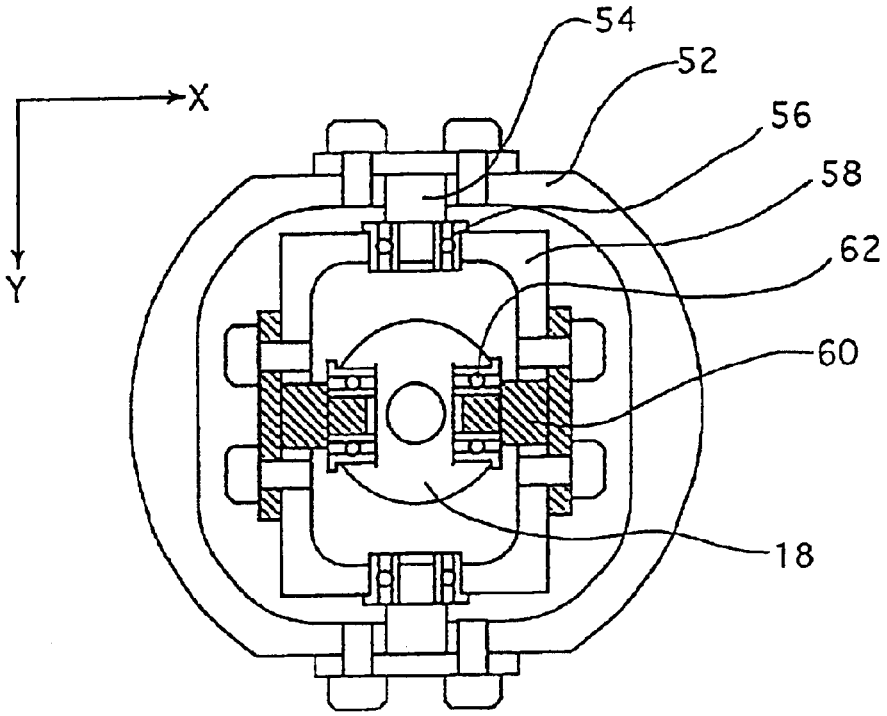
FIG. 4 is a perspective view along the section B—B of FIG. 3 showing the swing mechanism of the present invention.
Figure 5:
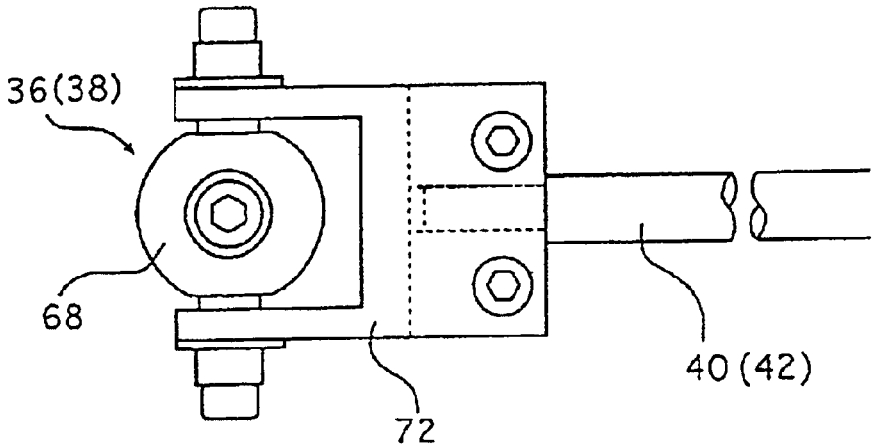
FIG. 5 is a perspective view along the section C—C of FIG. 3 showing the swing mechanism of the present invention.

FIG. 3. is a sectional view along the line A—A of FIG. 2 to show in detail a swing mechanism for swinging the spray nozzle pipe 18. FIG. 4 is a perspective view along the section B—B of FIG. 3 showing the swing mechanism. FIG. 5 is a perspective view along the section C—C of FIG. 3 showing the swing mechanism. The spray nozzle pipe 18 placed at the center in FIG. 3 is composed of a hollow pipe, has the flexible tube 24 (not shown in FIG. 3) connected to the upper end thereof, and discharges the finely-divided powders (spacers) 20 (not shown in FIG. 3) from an opening at the lower end thereof together with the gas stream. The spray nozzle pipe 18 is disposed on the mounting table 26 through a support unit (universal joint unit) 50 disposed at the center of the pipe 18 in the longitudinal direction thereof and can be swung in any of the X-axis direction and the Y-axis direction shown in FIG. 2.

As shown in FIG. 3 and FIG. 4, the support unit 50 of the spray nozzle pipe 18 is equipped with a joint ring 58 in the center hole of a joint base 52 fixed to the mounting table 26, which is supported through two support pins 54 disposed in parallel with a Y-axis and ball bearings 56 having the support pins 54 inserted, so that the joint ring 58 can rotate on the Y-axis. Further, the joint ring 58 supports the spray nozzle pipe 18 in the center hole through two support pins 60 disposed in parallel with the X-axis and the ball bearings 62 having the support pins 60 inserted, so that the joint ring 58 can rotate on the X-axis. Accordingly, the spray nozzle pipe 18 can be swung in any of the X-axis direction and the Y-axis direction and cannot be rotated on the centerline thereof.

The adjustable joints 36 and 38 of the first joint unit 35 are attached to the upper end of the spray nozzle pipe 18 and couple the pipe 18 with the second joint units 32 and 34 disposed on the inner sides of the linear-moving actuator 28 and 30 shown in FIG. 2 through the rods 40 and 42. As shown in FIG. 3 and FIG. 5, the adjustable joints (universal joints) 36 and 38 are attached to the upper end of the spray nozzle pipe 18 so as to project toward both the sides of the upper end in the X-axis direction. They are composed of two rotary rings 68 mounted on the upper end of the spray nozzle pipe 18 through ball bearings 66 which rotate in a horizontal direction and a joint arm 72 connected to the rotary rings 68 through ball bearings 70. When it is not necessary to so much increase the inclining angle of the spray nozzle pipe 18, spherical joints using spherical bearings may be employed in place of the adjustable joints 36 and 38 of the first joint unit 35 as the universal joints.

The rod 40 (42) is fixed to the joint arm 72 and coupled with the second joint unit 32 (34) of the linearly-moving actuator 28 (30) through the rod 40 (42), so that the movement of the linearly-moving actuator 28 (30) is transmitted to the spray nozzle pipe 18. The adjustable joints of the second joint units 32 and 34 of the linearly-moving actuators 28 and 30 may be the same as the adjustable joints 36 and 38, or any adjustable joints such as spherical joints may be employed.

The joint base 52 is fixed to the mounting table 26 through a mounting ring 74. The mounting ring 74 has an adjusting mechanism 76 for adjusting the position of the spray nozzle pipe 18. The lower end of the spray nozzle pipe 18 is inserted into a rubber cover 78 for hermetically sealing the chamber 12 as well as permitting the spray nozzle pipe 18 to swing. The outer periphery of the rubber cover 78 is fixed to the mounting table 26 through a fixing ring 80. When the spray mechanism 22 is driven, there is a possibility that dust and dirt are generated from the support unit 50 of the spray nozzle pipe 18 and the like although their amount may be negligible. The rubber cover 78 is attached to prevent the invasion of the dust and dirt other than the spacers into the chamber 12.

In the spray mechanism 22 arranged as described above for spraying the spacers 20, the spray nozzle pipe 18 is swung as described below by the movement of the linearly-moving actuator 28 (30), more specifically, by the movement of the slider 28*a* (30*a*) thereof along the guide 28*b* (30*b*).

Figure 6A:
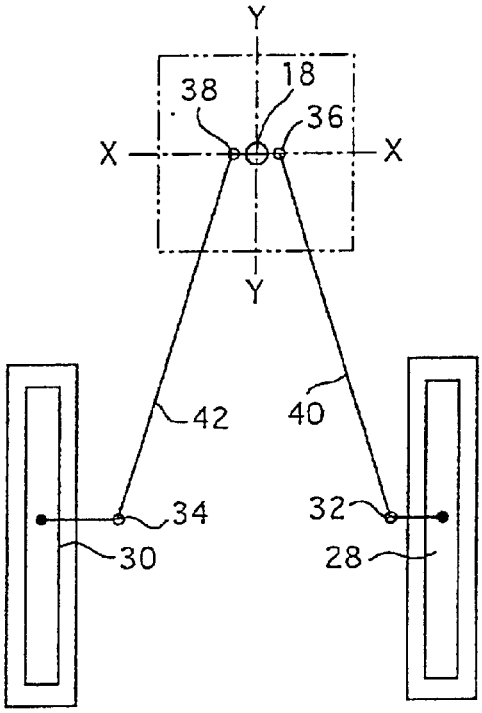
FIGS. 6A, 6B, 6C and 6D are illustrative views showing the swing of the spray nozzle pipe by the movements of the linearly-moving actuators in the finely-divided powder spray apparatus of the present invention.
Figure 6B:
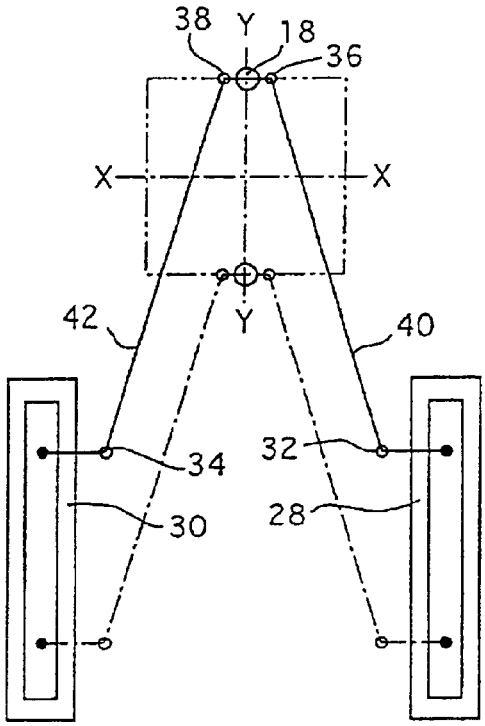
Figure 6C:
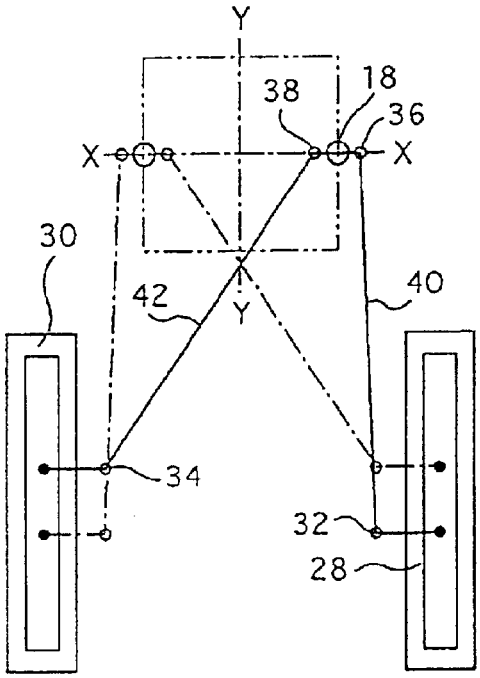
Figure 6D:
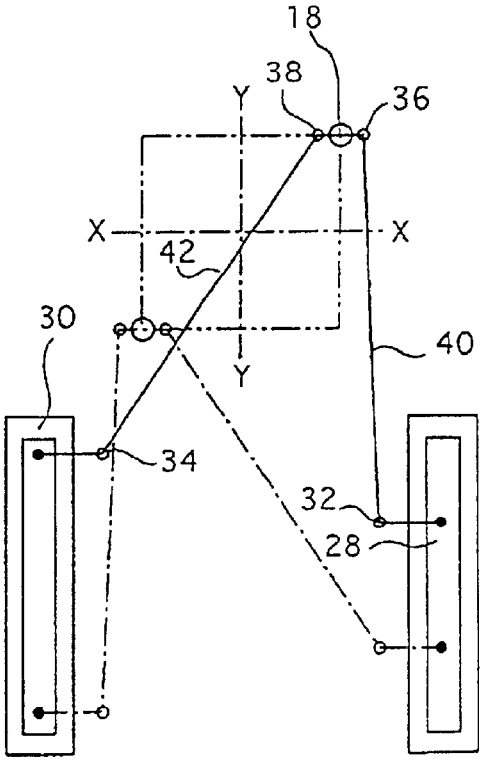

FIGS. 6A to 6D are illustrative views showing the swing of the spray nozzle pipe 18 by the movements of the slider 28*a* (30*a*) of the linearly-moving actuator 28 (30), respectively. FIG. 6A shows the spray nozzle pipe 18 being located at the center (vertical position) of a moving area. FIG. 6B shows the positions of the linearly-moving actuators 28 and 30, more specifically, the positions of the sliders 28*a* and 30*a* of the linearly-moving actuators 28 and 30 when the spray nozzle pipe 18 is swung to the limit position of the moving area in the Y-axis direction. FIG. 6C shows the positions of the linearly-moving actuators 28 and 30 (sliders 28*a* and 30*a*) when the spray nozzle pipe 18 is swung to the limit position of the moving area in the X-axis direction. FIG. 6D shows the spray nozzle pipe 18 being located in the corner of the moving area.

As illustrated in FIGS. 6A, 6B and 6C, when the spray nozzle pipe 18 is swung in the Y-axis direction, two linearly-moving actuators 28 and 30 simultaneously move in the same direction, and when the spray nozzle pipe 18 is swung in the X-axis direction, the two linearly-moving actuators 28 and 30 simultaneously move in the opposite direction each other. When the spray nozzle pipe 18 is swung at any other angle, it can be moved at any rate in the X-axis direction and the Y-axis direction by synthesizing the moving direction and speed of the two linearly-moving actuators 28 and 30, whereby the spacers 20 can be sprayed out to any position of the glass substrate 16.

Figure 7:
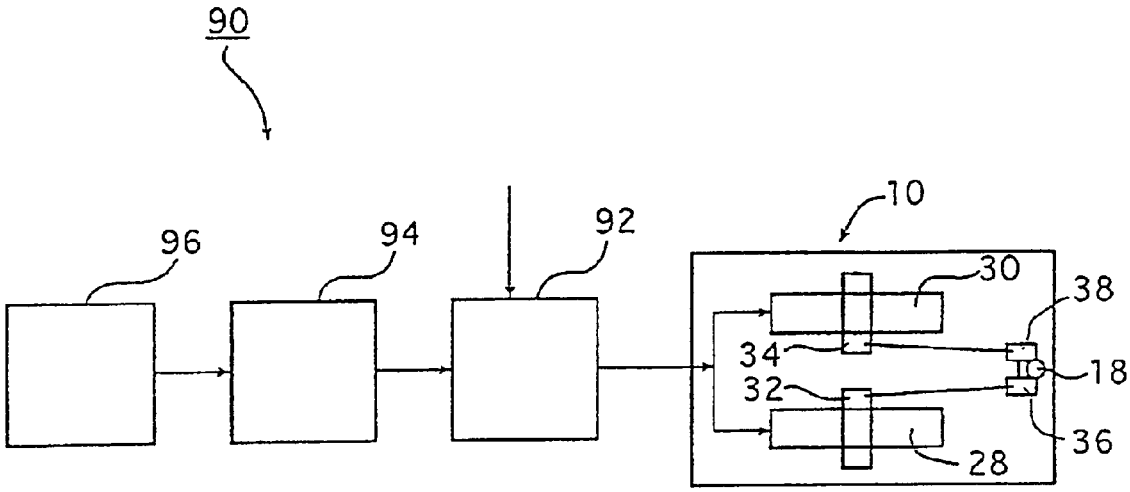
FIG. 7 is an illustrative view showing the system configuration of the finely-divided powder spray system including the spacer spray apparatus of the present invention.

FIG. 7 is a schematic view showing a system configuration of a finely-divided powder spray system 90 including a spacer spray apparatus 10. The finely-divided powder spray system 90 is composed of the spray apparatus 10, an actuator driver 92 electrically connected to the spray apparatus 10, more specifically, to the linearly-moving actuators 28 and 30 of the spray mechanism 22 for controlling them, a sequencer 94 electrically connected to the driver 92, and a touch panel 96 electrically connected to the sequencer 94 for operating the spray apparatus 10, especially entering the control factor to swing the sequencer 94.

It is described below how the spacers 20 are sprayed onto the glass substrate 16. Before the spacers 20 are sprayed onto the glass substrate 16, the spacers 20 must be sprayed onto a sample glass substrate by way of trial. In this trial spray, a locus, along which the spray nozzle pipe 18 moves, and a size of the glass substrate 16 (height ×width) must be entered by the touch panel 96. The entered data is transferred through the sequencer 94 to the actuator driver 92, which determines the locus to be drawn by an extension from the tip of the spray nozzle pipe 18 in a X-Y coordinate system on the glass substrate 16.

An origin of the X-Y coordinate system, in which corresponding locations on the glass substrate 16 are represented, is assumed to be an intersection of the perpendicularly-directed extension from the tip of the spray nozzle pipe 18 and the glass substrate 16. The locus drawn by the extension from the tip of the spray nozzle pipe 18 on the glass substrate 16 can be determined as a continuity of plural control points $((X_1, Y_1), (X_2, Y_2), (X_3, Y_3), (X_4, Y_4), \ldots (X_n, Y_n))$.

The actuator driver 92 calculates an incline angle of the spray nozzle pipe 18 in the X-Y direction from the locus drawn in the X-Y coordinate system on the glass substrate 16, and converts the control points in the X-Y coordinate system into the corresponding positions of the sliders 28*a* and 30*a* of the linearly-moving actuators 28 and 30 in the L1-L2 coordinate system $((L1_1, L2_1), (L1_2, L2_2), (L1_3, L2_3), (L1_4, L2_4), \ldots (L1_n, L2_n))$. In the L1-L2 coordinate system, sliding positions of the sliders 28*a* and 30*a* of the linearly-moving actuators 28 and 30 are represented.

Next, the actuator driver 92 operates the spacer spray apparatus 10, and changes the incline angle of the spray nozzle pipe 18 so as to shift the spray position along the determined locus at a temporary speed (V) while sequentially moving the sliders 28*a* and 30*a* of the linearly-moving actuators 28 and 30 to the positions $((L1_1, L2_1), (L1_2, L2_2), (L1_3, L2_3), (L1_4, L2_4), \ldots (L1_n, L2_n))$, whereby the spacers 20 are sprayed onto the sample glass substrate 16 in the trial spray.

Figure 8:
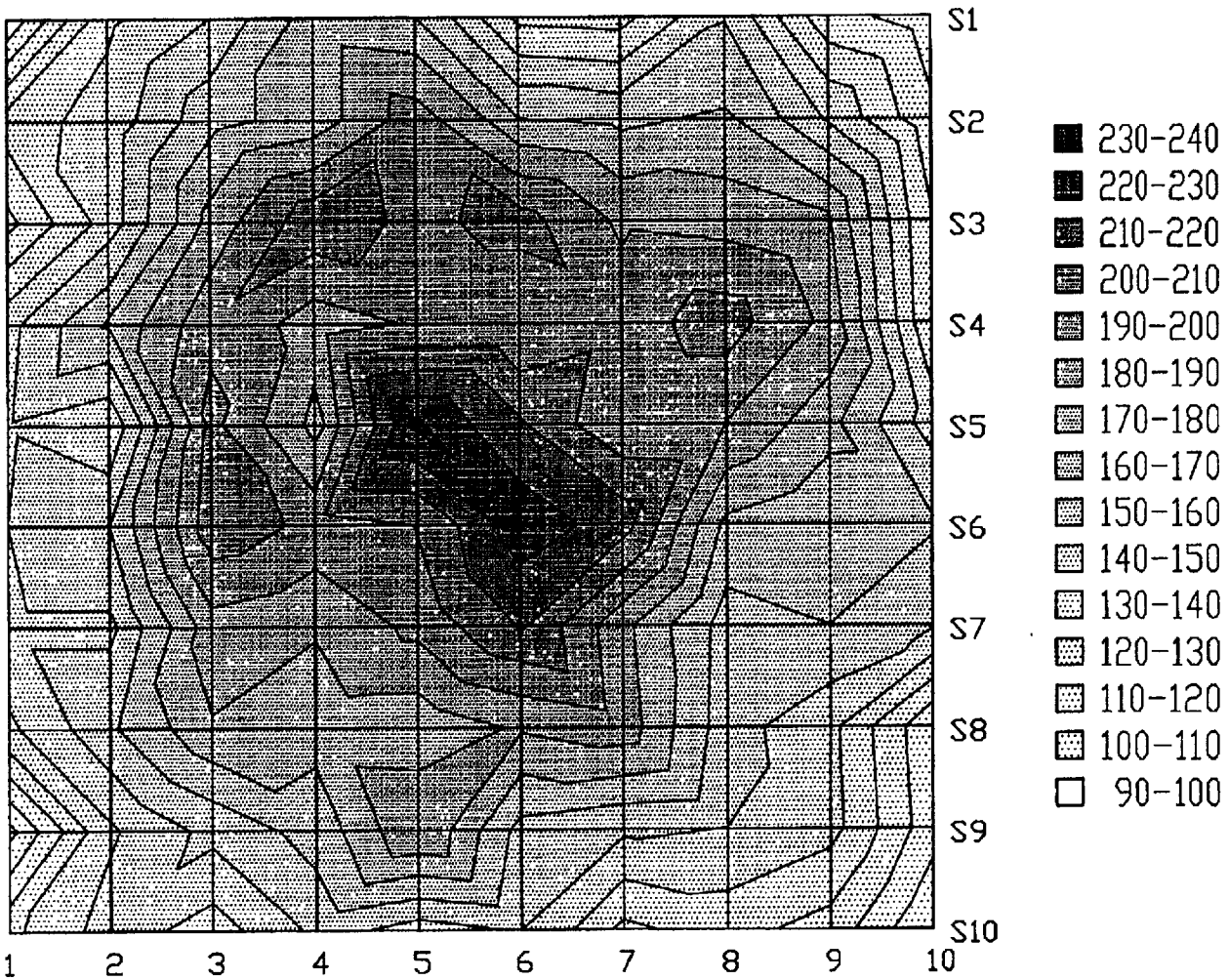
FIG. 8 is a graph showing a distribution of the densities of the deposited spacers on the whole surface of the glass substrate in a trial spray using the spacer spray apparatus of the present invention.
Figure 9:
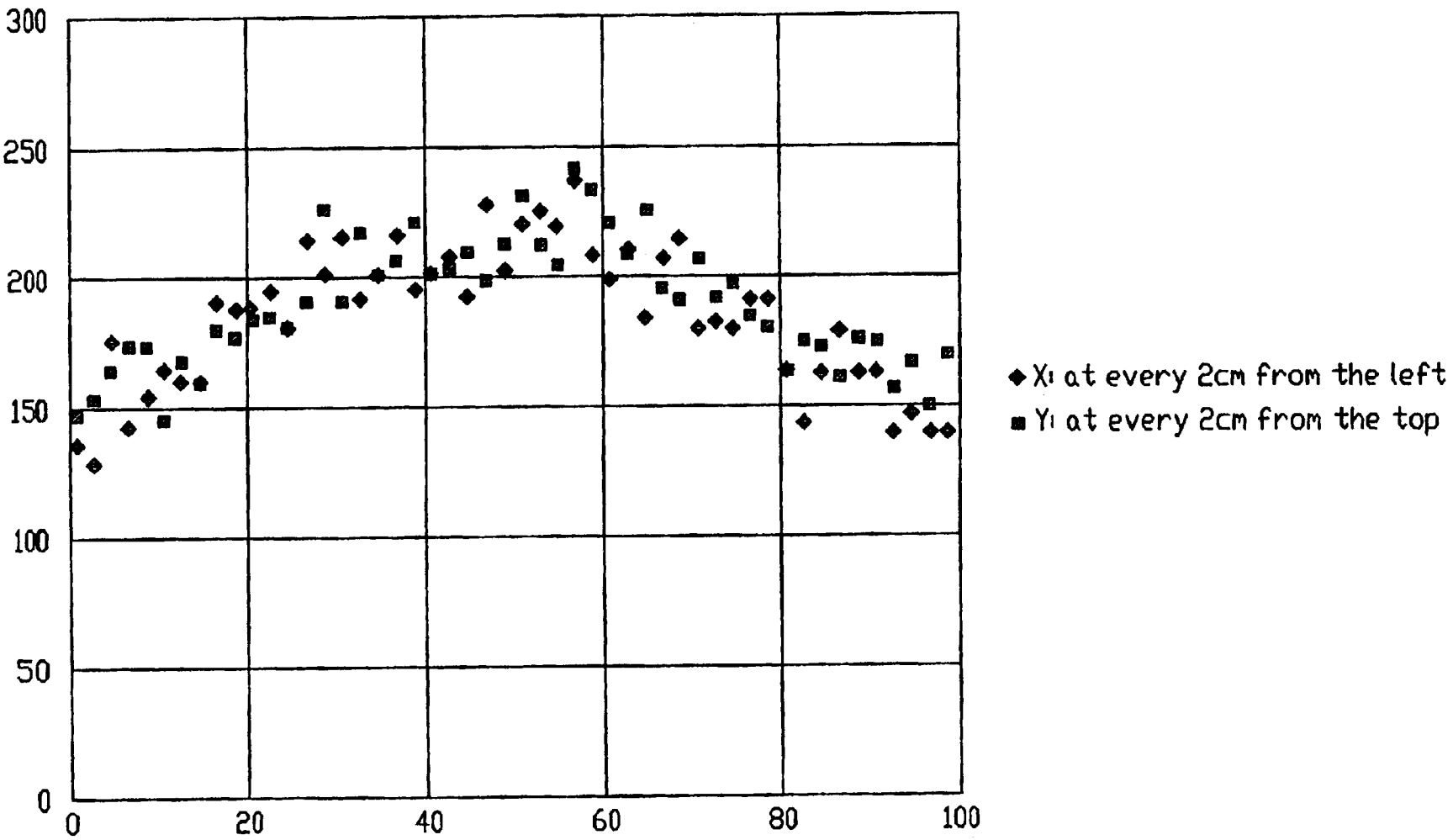
FIG. 9 is a graph showing the distribution of the densities of the deposited spacers measured on the X-axis and the Y-axis each passing through the center of the glass substrate at an interval of 2 cm in the trial spray using the spacer spray apparatus of the present invention.

After the trial spray, densities of the spacers 20 deposited on the sample glass substrate 16 are measured by a spacer counter (not shown in the figure). FIG. 8 is a graph showing a distribution of the densities (spacers/mm$^2$) of the spacers 20 deposited in the trial spray on the whole surface of the glass substrate having a size of 100 cm×100 cm. FIG. 9 is a graph showing the densities of the deposited spacers 20 measured on the X-axis and the Y-axis each passing through the center of the glass substrate 16 shown in FIG. 8 at an interval of 2 cm from the end. In FIG. 9, the density (spacers/mm$^2$) of the deposited spacers is represented along a vertical axis, and the distance (cm) from the end of the glass substrate 16 is represented along a horizontal axis.

As apparent from the measured values of the densities of the deposited spacers in the trial spray shown in FIG. 9, it may be considered that the density of the deposited spacers becomes lower in accordance with associated quadratic functions as the distance from a peak point of the density of the deposited spacers is more increased, and therefore, the quadratic functions based on the distance from the peak point of the density of the deposited spacers may be applied to obtain the reduction rate of the density of the deposited spacers. Thus, a distribution of the densities of the deposited spacers in the trial spray can be represented by the quadratic function indicating the reduction rate of the densities of the deposited spacers based on the distance from the peak point of the density.

A constant "a" in Expression 1 (X-axial quadratic function), i.e., a constant "a" for the reduction rate of the density of the deposited spacers based on the distance from the peak point in the X-axis direction can be obtained by measuring a density of the spacers deposited at a peak point "b" on the X-axis passing through the center of the glass substrate 16 in the trial spray and a density of the spacers deposited at any other point (measuring point) on the X-axis and calculating a distance between the peak point "b" and the measuring point. When the peak point "b" is placed at the center of the glass substrate 16, a value for "b" is zero (0).

Accordingly, the moving-speed of the spray point between the control points ($X_1$, $Y_1$) and ($X_2$, $Y_2$) can be determined based on the distance between the control point ($X_1$, $Y_1$) and the peak point on the X-axis, and the distance between the control point ($X_1$, $Y_1$) and the peak point on the Y-axis. The distance between the control point ($X_1$, $Y_1$) and the peak point on the X-axis is used to obtain the reduction Expression 1

$$\text{Peak reference density rate} = a\left[\frac{\text{Measuring point (= distance from peak point)} - b}{\text{Substrate size} \times \frac{1}{2}}\right]^2 + 1$$

For example, actual values are entered in the expression to obtain the reduction rate constant "$a_x$". It is assumed that a point 50 cm apart from a left end of the X-axis on the sample glass substrate 16 is the peak point and that a point at the left end of the X-axis is the measuring point. Assuming that the density of the spacers deposited on the peak point is 230 (spacers/mm$^2$) and that the density of the spacers deposited on the measuring point is 150 (spacers/mm$^2$) with reference to FIG. 9, the peak reference density rate is 150/230, the measuring point is 50 (cm), "b" is 0 (cm), and the substrate size x ½ is 50 (cm), respectively in Expression 1, which is evaluated to find the reduction rate constant "$a_x$" approx. −0.348.

Further, a density of the deposited spacers at the peak point "b" on the Y-axis passing through the center of the glass substrate 16 in the trial spray and a density of the deposited spacers at any other point (measuring point) on the Y-axis are measured, respectively, and a distance between the peak point "b" and the measuring point is calculated, which gives the constant "a" in Expression 1 (Y-axial quadratic function), i.e., the reduction rate constant "$a_y$" of the density of the deposited spacers based on the distance from the peak point in the Y-axis direction. When the peak point "b" is located at the center of the glass substrate 16, the value for "b" is zero (0) in this case also.

In Expression 1, actual values are used to obtain the reduction rate constant "$a_y$". It is assumed that a point 50 cm apart from a top end along the Y-axis on the sample glass substrate 16 is the peak point and that a point at the top end of the Y-axis is the measuring point. Assuming that the density of the spacers deposited on the peak point is 240 (spacers/mm$^2$) and that the density of spacers deposited on the measuring point is 150 (spacers/mm$^2$) with reference to FIG. 9, the peak reference density rate is 150/240, the measuring point is 50 (cm), "b" is 0 (cm), and the substrate size x ½ is 50 cm, respectively in Expression 1, which is evaluated to find the reduction rate constant "$a_y$" approx. −0.375.

Next, the reduction rate constant "$a_x$" (−0.348) based on the distance from the peak point in the X-axis direction and the reduction rate constant "$a_y$" (−0.375) based on the distance from the peak point in the Y-axis direction are entered by a touch panel 96, and transferred to the actuator driver 92 through the sequencer 94. The actuator driver 92 calculates a moving-speed of the spray point corresponding to the intersection of the extension from the spray nozzle pipe 18 between control points in the X-Y coordinate system and the surface of the glass substrate 16.

rate of the density of the deposited powders based on the distance from the peak point in the X-axis direction, i.e., the peak reference density rate (reduction rate of the density of the deposited finely-divided powders) "$R_{x1}$". The distance from the peak point on the Y-axis is used to obtain the reduction rate of the density of the deposited powders based on the distance from the peak point in the Y-axis direction, i.e., the peak reference density rate (the reduction rate of the density of the deposited finely-divided powders) "$R_{y1}$". The moving-speed (temporary speed V) of the spray point in the trial spray is then multiplied by the peak reference density rates "$R_{x1}$" and "$R_{y1}$" to obtain the moving-speed ($R_{x1}\times R_{y1}\times$ V) of the spray point between the control points ($X_1$, $Y_1$) and ($X_2$, $Y_2$).

When the control point ($X_1$, $Y_1$) is a point (10, 10), for example, "$R_1$" is 0.777 and "$R_{y1}$" is 0.760, which are obtained from Expression 1, respectively, and the moving-speed ($R_{x1}\times R_{y1}\times$V) of the spray point between the control points ($X_1$, $Y_1$) and ($X_2$, $Y_2$) can be evaluated as 0.59 V. This means that the moving-speed of the spray point may be controlled to 0.59 times the temporary moving-speed V in the trial spray.

In the same manner, the moving-speed ($R_{x2}\times R_{y2}\times$V) of the spray point between the control points ($X_2$, $Y_2$) and ($X_3$, $Y_3$) can be determined based on the distance between the control point ($X_2$, $Y_2$) and the peak point on the X-axis and the distance between the control point ($X_2$, $Y_2$) and the peak point on the Y-axis. Additionally, the moving-speed ($R_{x3}\times R_{y3}\times$V) of the spray point between the control points ($X_3$, $Y_3$) and ($X_4$, $Y_4$) and the moving-speed ($R_{x(n-1)}\times R_{y(n-1)}\times$V) of the spray point between the control points ($X_{n-1}$, $Y_{n-1}$) and ($X_n$, $Y_n$) can be obtained. Since the term on the left side of Expression 1, i.e., the peak reference reduction rate "$R_x$" and the peak reference reduction rate "$R_y$" each always satisfy the condition ($0<R_x<1$; $0<R_y<1$), the moving-speed of the spray point and accordingly the moving-speed of the spray nozzle pipe 18 are lowered under control as the spray point is more distant from the peak point.

Next, the actuator driver 92 calculates the moving-speeds of the sliders 28*a* and 30*a* of the linearly-moving actuators 28 and 30 based on the distance between the control points in the X-Y coordinate system and the moving-speed of the spray point. More specifically, the actuator driver 92 calculates the moving-speeds of the sliders 28*a* and 30*a* of the linearly-moving actuators 28 and 30 between ($L1_1$, $L2_1$) and ($L1_2$, $L2_2$), based on the distance between the control points ($X_1$, $Y_1$) and ($X_2$, $Y_2$) and the moving-speed ($R_{x1}\times R_{y1}\times$V) of the spray point between the control points ($X_1$, $Y_1$) and ($X_2$, $Y_2$). In the same manner, the actuator driver 92 calculates the moving-speeds of the sliders 28*a* and 30*a* of the linearly-moving actuators 28 and 30 between ($L1_2$, $L2_2$) and ($L1_3$, $L2_3$), between ($L1_3$, $L2_3$) and ($L1_4$, $L2_4$), and between ($L1_{n-1}$, $L2_{n-1}$) and ($L1_n$, $L2_n$), respectively.

Next, the glass substrate 16, onto which the finely-divided powders is actually sprayed, is positioned and fixed on the table 14 installed in the hermetically-sealed chamber 12. The glass substrate 16 must be fixed at the same position as the sample glass substrate used in the trial spray of the spacers 20.

Next, the actuator driver 92 operates the spacer spray apparatus 10 to spray the spacers 20 onto the glass substrate 16 while sequentially moving the sliders 28*a* and 30*a* of the linearly-moving actuators 28 and 30 to the positions ($L1_1$, $L2_1$), ($L1_2$, $L2_2$), ($L1_3$, $L2_3$), ($L1_4$, $L2_4$), . . . ($L1_n$, $L2_n$) at the calculated speeds. Accordingly, the spacers 20 can be sprayed onto the glass substrate 16 while shifting the spray point between the control points ($X_1$, $Y_1$) and ($X_2$, $Y_2$) at the moving-speed of ($R_{x1}\times R_{y1}\times V$), the spray point between the control points ($X_2$, $Y_2$) and ($X_3$, $Y_3$) at the moving-speed of ($R_{x2}\times R_{y2}\times V$), the spray point between the control points ($X_3$, $Y_3$) and ($X_4$, $Y_4$) at the moving-speed of ($R_{x3}\times R_{y3}\times V$), and the spray point between the control points ($X_{n-1}$, $Y_{n-1}$) and ($X_n$, $Y_n$) at the moving-speed of ($R_{x(n-1)}\times R_{y(n-1)}\times V$), respectively.

Figure 10:
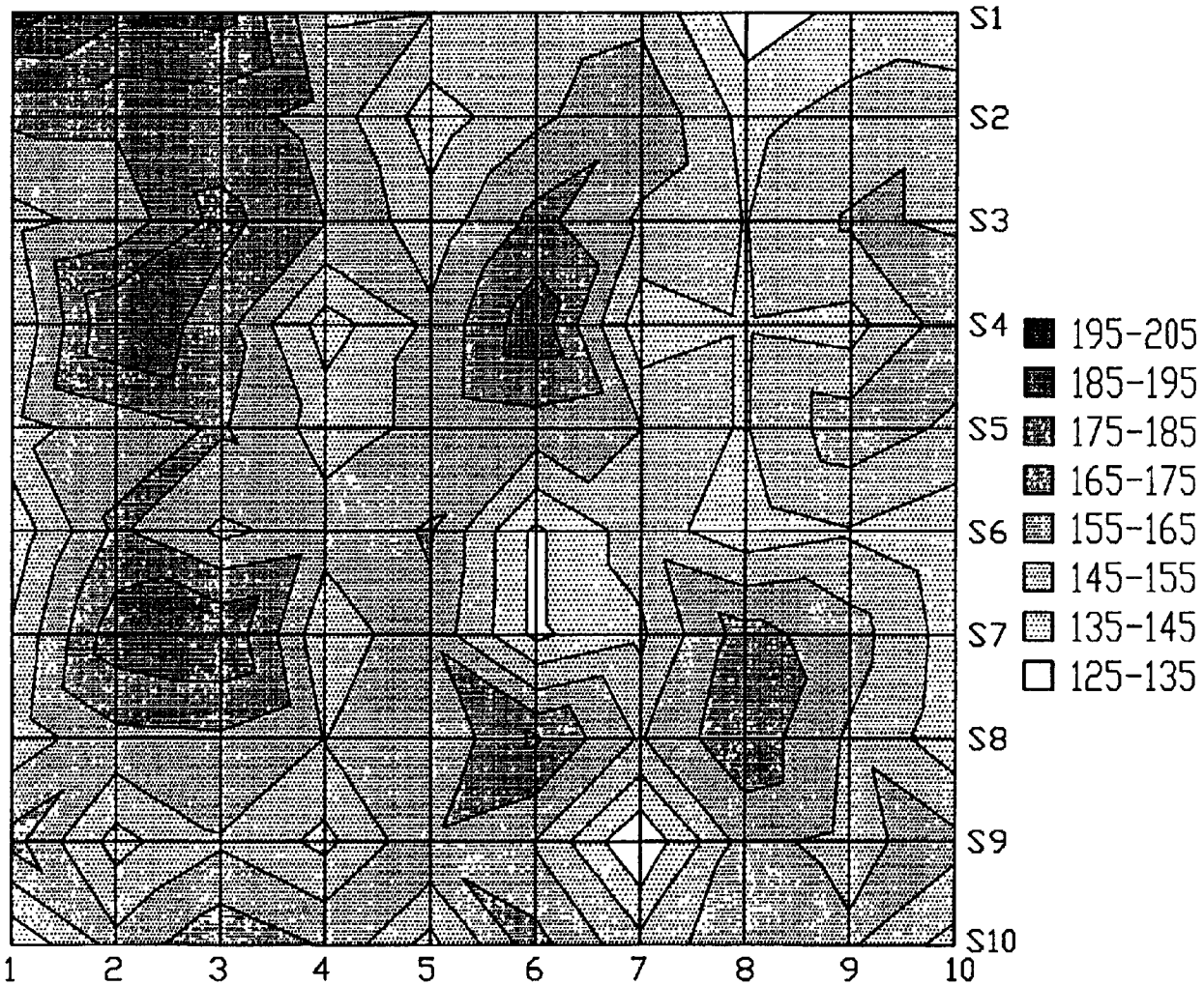
FIG. 10 is a graph showing a distribution of the densities of the deposited spacers on the whole surface of the glass substrate, the spacers being sprayed by the spacer spray apparatus of the present invention.
Figure 11:
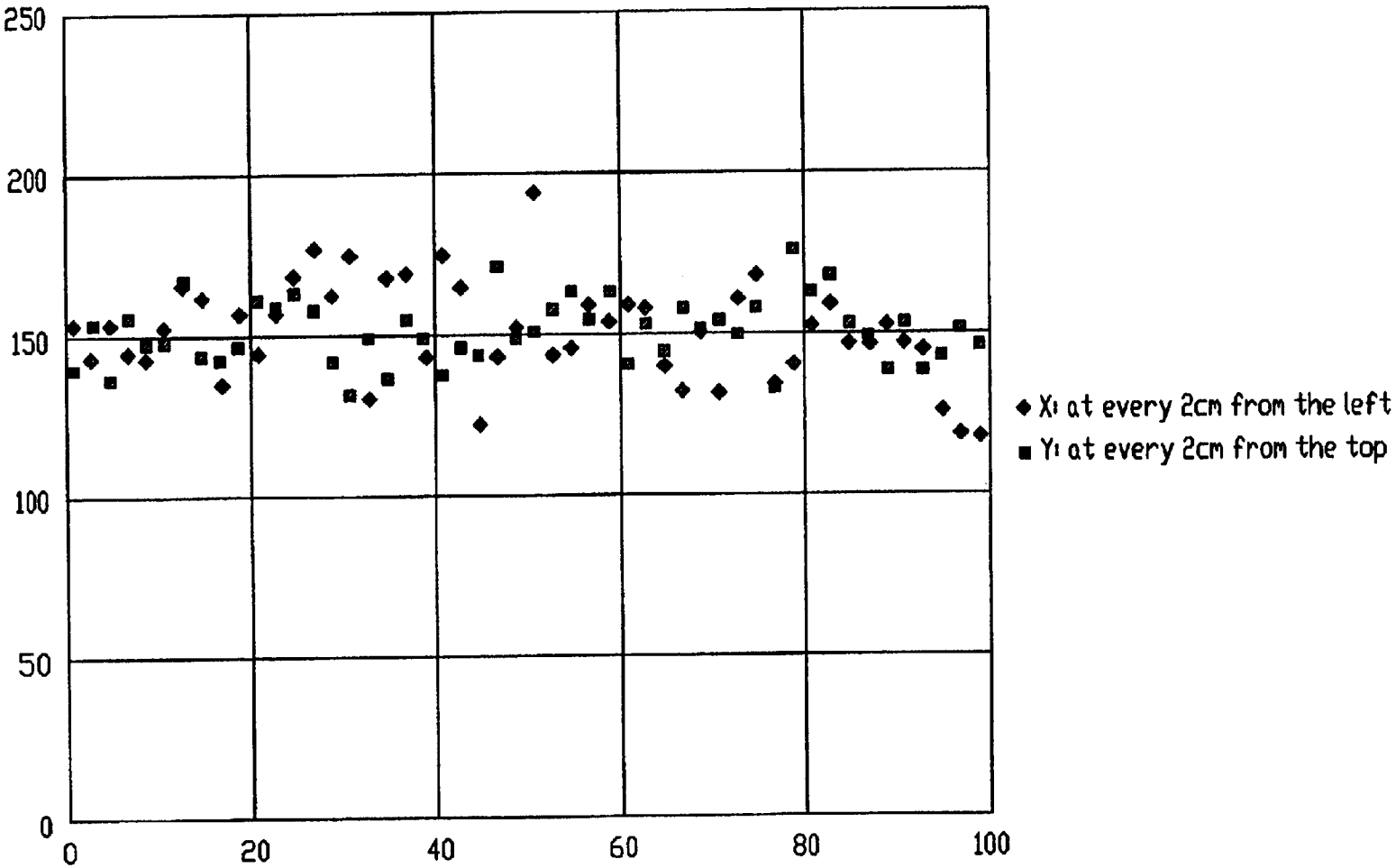
FIG. 11 is a graph showing the distribution of the densities of the deposited spacers measured on the X-axis and the Y-axis each passing through center of the glass substrate at an interval of 2 cm, the spacers being sprayed by the spacer spray apparatus of the present invention.

FIG. 10 is a graph showing a distribution of the densities (spacers/mm$^2$) of the spacers 20 deposited on the whole surface of the glass substrate 16 after spray. FIG. 11 is a graph showing the densities of the sprayed spacers 20 (spacers/mm$^2$) on the X-axis and Y-axis each passing through the center of the glass substrate 16 shown in FIG. 10 at an interval of 2 cm from the end. In FIG. 11, the density of the deposited spacers (spacers/mm$^2$) is represented along a vertical axis and the distance (cm) from the end of the substrate is represented along a horizontal axis.

As apparent from the results of the measurements shown in FIG. 11, the moving-speed of the spray nozzle pipe 18 is lowered under control as the spray point is more distant from the center point of the glass substrate 16, and therefore, the spacers 20 can be uniformly sprayed onto the whole surface of the glass substrate 16. After one glass substrate 16 has been sprayed with the spacers 20, another glass substrate 16 will be sprayed with the spacers 20 subsequently in the same way.

According to the spacer spray apparatus 10 of the present invention, the moving-speed of the tip of the spray nozzle pipe 18 is lowered under control in accordance with the quadratic function, which indicates the reduction rate of the density of the deposited finely-divided powders based on the distance between a peak point of the density of the powders deposited in the trial spray and a spray point, as the reduction rate of the density of the deposited finely-divided powders is increased, whereby the finely-divided powders can be uniformly sprayed onto a larger glass substrate 16.

In the aforementioned embodiment, the spacer spray apparatus 10 sprays the spacers 20 onto the glass substrate 16 positioned and horizontally fixed on the table 14 by swinging the spray nozzle pipe 18 disposed above the glass substrate so that the spacers 20 are uniformly sprayed downward. However, the present invention is by no means limited to the aforementioned embodiment. Any types of finely-divided powders which should be a uniformly sprayed can be used, for example, powder paints, toner, etc. in addition to the spacers. Any members to be sprayed can also be used, for example, objects to be coated by powder paints in addition to the glass substrate. They are not limited to those horizontally fixed on the table 14, and can be, for example, those not mounted on the table, vertically-disposed substrates and parts to be painted, and inclined substrates and parts to be painted. The direction in which the spacers are sprayed onto the member to be sprayed is also not limited to the aforementioned embodiment and the spacers may be sprayed onto the horizontally-disposed or inclined member in any of the perpendicularly-downward and oblique directions as well as onto the vertically-disposed or inclined member in any of the horizontal and oblique directions.

In the aforementioned embodiment, the spray nozzle pipe 18 is swung in the X-axis direction and the Y-axis direction by controlling the sliders 28*a* and 30*a* of the linearly-moving actuators 28 and 30. However, the present invention may be applied to a spacer display apparatus of which spray nozzle pipe 18 is swung in the X-axis direction and the Y-axis direction through a crank or an eccentric cam linked to the motor.

According to the present invention, the moving-speed of the tip of the spray nozzle pipe 18 is lowered under control by a moving-speed control means in accordance with the quadratic function, which indicates the reduction rate of the density of the deposited finely-divided powders based on the distance between the peak point in the trial spray and the spray point, as the reduction rate of the density of the sprayed finely-divided powder is increased, whereby the finely-divided powders may be uniformly sprayed on the larger member to be sprayed.

What is claimed is:

1. A finely-divided powder spray apparatus comprising:

a spray nozzle configured to discharge finely-divided powders from a tip portion thereof together with a gas flow onto a member to be sprayed;

a calculating unit configured to calculate a density distribution function indicating a density of the finely-divided powders deposited at each spray point on the surface of said member in a trial spray; and a moving-speed control device configured to control a moving-speed of the tip portion of said spray nozzle based on the density distribution function.

2. A finely-divided powder spray apparatus according to claim 1, wherein said calculating unit obtains said density distribution function indicating a reduction rate of a density of the finely-divided powders as a quadratic function of a distance between a peak point of the density in said trial spray and a spray point at which an extension from said spray nozzle intersects with said member.

3. A finely-divided powder spray apparatus according to claim 2, wherein said calculating unit obtains said quadratic function including a X-axis quadratic function and a Y-axis quadratic function, the X-axis quadratic function indicating a reduction rate of a density of the finely-divided powders based on a distance between said peak point on an X-axis and said spray point, the Y-axis quadratic function indicating a reduction rate of a density of the finely-divided powders based on a distance between said peak point on a Y-axis and said spray point.

4. A finely-divided powder spray apparatus according to claim 3, wherein the moving-speed control device decreases moving-speed of the tip portion of said spray nozzle as the reduction rate of the density of said finely-divided powders is increased.

5. A finely-divided powder spray apparatus according to claim 2, wherein the moving-speed control device decreases moving-speed of the tip portion of said spray nozzle as the reduction rate of the density of said finely-divided powders is increased.

6. A finely-divided powder spray apparatus according to claim 1, wherein the moving-speed control device decreases moving-speed of the tip portion of said spray nozzle as a reduction rate of the density of said finely-divided powders is increased.

7. A finely-divided powder spray apparatus according to claim 1, wherein said spray nozzle is configured to discharge spacers for liquid crystal displays onto a substrate of liquid crystal displays.

8. A finely-divided powder spray apparatus comprising:

a spray nozzle configured to discharge finely-divided powders from a tip portion thereof together with a gas flow onto a member to be sprayed;

calculating means for calculating a density distribution function indicating a density of the finely-divided powders deposited at each spray point on the surface of said member in a trial spray; and moving-speed controlling means for controlling a moving-speed of the tip portion of said spray nozzle based on the density distribution function.

* * * * *